US008672243B2

(12) United States Patent
Turcic et al.

(10) Patent No.: US 8,672,243 B2
(45) Date of Patent: Mar. 18, 2014

(54) CENTRIFUGE NOZZLE AND METHOD AND APPARATUS FOR INSERTING SAID NOZZLE INTO A CENTRIFUGE BOWL

(75) Inventors: Joseph Turcic, Maple Glen, PA (US); Kenneth Gustavsson, Tullinge (SE)

(73) Assignee: Alfa Laval Corporate AB, Lund (SE)

( * ) Notice: Subject to any disclaimer, the term of this patent is extended or adjusted under 35 U.S.C. 154(b) by 1226 days.

(21) Appl. No.: 11/662,456

(22) PCT Filed: Sep. 8, 2005

(86) PCT No.: PCT/US2005/031847

§ 371 (c)(1),
(2), (4) Date: Mar. 5, 2008

(87) PCT Pub. No.: WO2006/029200

PCT Pub. Date: Mar. 16, 2006

(65) Prior Publication Data

US 2009/0140081 A1 Jun. 4, 2009

Related U.S. Application Data

(60) Provisional application No. 60/608,002, filed on Sep. 8, 2004, provisional application No. 60/687,002, filed on Jun. 4, 2005.

(51) Int. Cl.

| | |
|---|---|
| ***B05B 1/00*** | (2006.01) |
| ***B05B 1/02*** | (2006.01) |
| ***B04B 1/10*** | (2006.01) |
| ***B04B 11/00*** | (2006.01) |

(52) U.S. Cl.
USPC ..... 239/589; 239/591; 239/600; 494/56

(58) Field of Classification Search
USPC ..... 239/379, 223, 224, 600, 289, 390, 589, 239/591–595; 494/53, 56, 85; 175/390, 424
See application file for complete search history.

(56) References Cited

U.S. PATENT DOCUMENTS

| | | | | |
|---|---|---|---|---|
| 2,695,748 | A | 11/1954 | Millard | |
| 3,075,696 | A * | 1/1963 | Fitzsimmons | 494/56 |
| 4,190,194 | A | 2/1980 | Amero | |
| 4,583,694 | A | 4/1986 | Williams et al. | |
| 4,794,995 | A * | 1/1989 | Matson et al. | 175/393 |
| 5,033,680 | A | 7/1991 | Schultz | |
| 5,388,962 | A * | 2/1995 | Wygle et al. | 416/95 |
| 6,033,326 | A * | 3/2000 | Lee | 473/560 |
| 6,216,959 | B1 * | 4/2001 | Garrison et al. | 239/1 |
| 6,429,563 | B1 * | 8/2002 | Rothman et al. | 310/149 |
| 6,511,005 | B2 * | 1/2003 | Bouchillon et al. | 239/589 |
| 6,952,905 | B2 * | 10/2005 | Nickel et al. | 52/711 |
| 7,326,169 | B2 * | 2/2008 | Bruning et al. | 494/56 |
| 7,614,995 | B2 * | 11/2009 | Schulz et al. | 494/56 |
| 2005/0164861 | A1 | 7/2005 | Bruning et al. | |

FOREIGN PATENT DOCUMENTS

| | | | |
|---|---|---|---|
| DE | 195 35 485 | A1 | 3/1997 |
| WO | WO 02/078859 | A | 10/2002 |

* cited by examiner

*Primary Examiner* — Darren W Gorman
(74) *Attorney, Agent, or Firm* — MKG, LLC

(57) ABSTRACT

In a centrifuge nozzle a nozzle body defines an inlet in fluid communication with a nozzle outlet. The nozzle body is adapted to be releasably positioned in an aperture defined by a centrifuge bowl assembly. A camming portion projects outwardly from the nozzle body and defines a surface frictionally engageable with a portion of the bowl assembly. The nozzle body also defines a male mounting portion for slidably engaging a complimentarily shaped female slot defined by a nozzle insertion and extraction tool. The outlet of the nozzle is located adjacent to the male mounting portion.

6 Claims, 10 Drawing Sheets

CENTRIFUGE NOZZLE AND METHOD AND APPARATUS FOR INSERTING SAID NOZZLE INTO A CENTRIFUGE BOWL

CROSS REFERENCE TO RELATED APPLICATIONS

This application claims the benefit of U.S. Provisional Patent Applications 60/608,002, having a filing date of Sep. 8, 2004, and 60/687,002, having a filing date of Jun. 4, 2005, both applications being incorporated herein by reference in their entirety.

FIELD OF THE INVENTION

The present invention is generally related to centrifugal separation equipment and is more particularly directed to a centrifuge nozzle and a tool for inserting and extracting the nozzle to and from a centrifuge bowl.

BACKGROUND OF THE INVENTION

Centrifuges are commonly used to separate slurries into their constituent components via the imposition of centrifugal force. The slurries usually include at least two phases each having a density that is different from the other. These phases are generally a combination of liquids, solids, and/or gases. To generate the centrifugal force required to separate the slurry into its components, the centrifuge usually includes a high-speed rotating vessel into which the slurry is fed. This vessel is referred to by those skilled in the pertinent art to which the present invention pertains as a "bowl." Once in the rotating bowl, the slurry is entrained in the rotation and centrifugal force acts on the slurry causing it to separate intro its constituent components. Outlets are typically positioned around the periphery of the bowl to allow for the removal of at least one of the separated constituents from the bowl.

One type of centrifuge commonly employed to accomplish the above-described separation is referred to by those skilled in the pertinent art as a disc-nozzle centrifuge. In this type of machine, the rotating bowl includes a plurality of nozzles circumferentially positioned around the outermost periphery of the bowl. Each nozzle includes an inlet portion in communication with an interior area defined by the rotor bowl and an outlet to allow separated material to escape from the rotor bowl. During operation, the slurry is typically fed into the bowl and acted on by centrifugal forces so that the heavier phase of the slurry collects at the inner periphery of the bowl and enters the nozzles where it is discharged from the bowl. The nozzles can also be positioned around a peripheral surface other than the outermost periphery of the rotor bowl. In cases where the nozzles are positioned at a smaller radius from the rotational axis, less horsepower is required to operate the centrifuge.

Sometimes, due to wear or other maintenance issues, it is necessary to remove the nozzles from the bowl. This can be problematic in that the nozzles are typically held in the bowl via the frictional engagement of a portion of the nozzle with a portion of the bowl. Historically, the nozzles have been configured with a slot to allow them to be turned away from the frictional fit using a screwdriver. Once the frictional fit is overcome the nozzle can be positioned to be pulled from the bowl. However, since the screwdriver used to turn the nozzle is unable to exert a pulling force on the nozzle it is often quite difficult to remove the nozzle from the bowl. Generally, resort has been had to prying the nozzle from the bowl which can result in damage to one or both of the nozzle and the bowl.

Another problem sometimes occurs when inserting the nozzle into the bowl. In order for the centrifuge to function properly the nozzle must be correctly aligned relative to the bowl. By employing the above-described slot and screwdriver to turn the nozzle into the frictional fit, it is possible to not fully rotate the nozzle relative to the bowl, thereby resulting in an improper nozzle orientation.

Still another problem associated with the above-described prior art nozzles results from there being insufficient material at the end of a nozzle to accommodate the slot for the screwdriver. This results in the nozzle discharge having to be positioned in a less than optimal location and orientation (i.e., closer to the inlet of the nozzle such that the flow path between the inlet and the nozzle outlet of the discharge has a relatively tight radius or such that the fluid is dispelled substantially radially from the nozzle). Depending on the nozzle discharge orientation, considerably more or less power is required to operate the centrifuge.

Even when the above-described prior art nozzles are properly positioned, large amounts of horsepower are required to drive the centrifuge. A large part of the horsepower requirement is due to the operation and design of the nozzles. Properly orienting the nozzle discharge can have dramatic effects on the amount of horsepower required to drive the centrifuge bowl. A drawback of the above-described nozzle is that the slot does not allow the nozzle discharge to be located closer to the outermost surface of the nozzle. This in turn results in a less than optimal nozzle discharge angle relative to the periphery of the bowl.

Based on the foregoing, it is the general object of the present invention to provide a centrifuge nozzle, and a nozzle insertion and extraction tool that improves upon or overcomes the problems and drawbacks of the prior art.

SUMMARY OF THE PRESENT INVENTION

The present invention is directed in one aspect to a centrifuge nozzle having a nozzle body that defines an inlet in fluid communication with a nozzle outlet. The nozzle is adapted to be releasably positioned in an aperture defined by a centrifuge bowl. A camming portion projects outwardly from the nozzle body and defines a surface frictionally engageable with a portion of the rotor bowl. The nozzle body defines a male mounting portion for slidably engaging a complimentarily shaped female slot defined by a nozzle insertion and extraction tool. The nozzle outlet is located adjacent to the male mounting portion.

Preferably, the male mounting portion of the centrifuge nozzle and the female slot defined by the insertion and extraction tool are each dovetail shaped. In addition, in the preferred embodiment of the present invention, the nozzle defines a longitudinal axis extending axially thereof in a first coordinate direction. The nozzle outlet is symmetrical about a centerline and is preferably oriented at an angle of approximately 10 degrees relative to a second coordinate direction approximately perpendicular to the first coordinate direction.

In an embodiment of the centrifuge nozzle of the present invention, an insert is positioned within the nozzle body and is made from a suitable wear-resistant material such as, but not limited to, tungsten carbide. The insert includes an inlet that is in fluid communication with the nozzle body inlet, and an outlet that is in fluid communication with the nozzle body outlet and preferably coaxial therewith.

In another aspect, the present invention is directed to a tool for inserting and extracting a nozzle into and from a centrifuge bowl. The insertion and extraction tool includes a handle portion and a shaft portion extending from the handle portion.

An end portion extends from the shaft portion generally opposite the handle portion and defines a female slot adapted to slidably engage the above-described male mounting portion defined by the centrifuge nozzle. Preferably, the slot is dovetail shaped.

The present invention further resides in a method for inserting a nozzle into a centrifuge bowl, the bowl defining a plurality of apertures positioned around a periphery thereof. Each of the apertures is located within a recess defined by the bowl. Using the above described nozzle and the insertion and extraction tool, the female slot in the tool is slidably engaged with the male mounting portion of a nozzle. The nozzle body is inserted into one of the apertures defined by the bowl and the tool is rotated causing the camming surface projecting outwardly from the nozzle to frictionally engage the bowl. With the camming surface engaging the bowl, the slot in the insertion and extraction tool will be aligned with the recess, thereby allowing the tool to be slid off of the nozzle and removed. If the nozzle is not properly installed, the tool cannot be removed there from.

One advantage of the present invention is that because an outwardly projecting dovetail-shaped end surface is employed by the nozzle rather than the conventional screwdriver slot, there is more material at the nozzle end allowing the nozzle outlet to be moved farther out along the nozzle body. This in turn allows for greater flexibility in adjusting the discharge angle of the nozzle relative to the rotor bowl. Optimization of the discharge angle can result in significant reductions in power requirements to operate the centrifuge.

The additional material at the nozzle end that allows the nozzle outlet to be moved farther out along the nozzle body allows for the passageway between the nozzle inlet and the nozzle outlet to be of a larger radius than it was in conventional designs. A larger radius passageway means that the fluid deflected through the nozzle is subject to less drastic directional changes, which allow for smoother fluid transfer through the nozzle. Accordingly, the turbulence of the flow is reduced, which enables the nozzle to experience less wear.

Another advantage of the present invention is that the use of the mating dovetail-shaped slot and projection allows force to be exerted on the nozzle by the insertion and extraction tool when the nozzle is being removed from the rotor bowl. More specifically, the nozzle can be pulled from rotor bowl when removal of the nozzle is desired. This was heretofore not possible when employing the conventional screwdriver slot because the screwdriver could not be releasably attached to the nozzle. Accordingly, time is saved when removing or installing nozzles. In addition, damage to the rotor bowl, which usually results from attempting to pry a nozzle from the bowl, is avoided.

DETAILED DESCRIPTION OF THE PREFERRED EMBODIMENT

Figure 1:
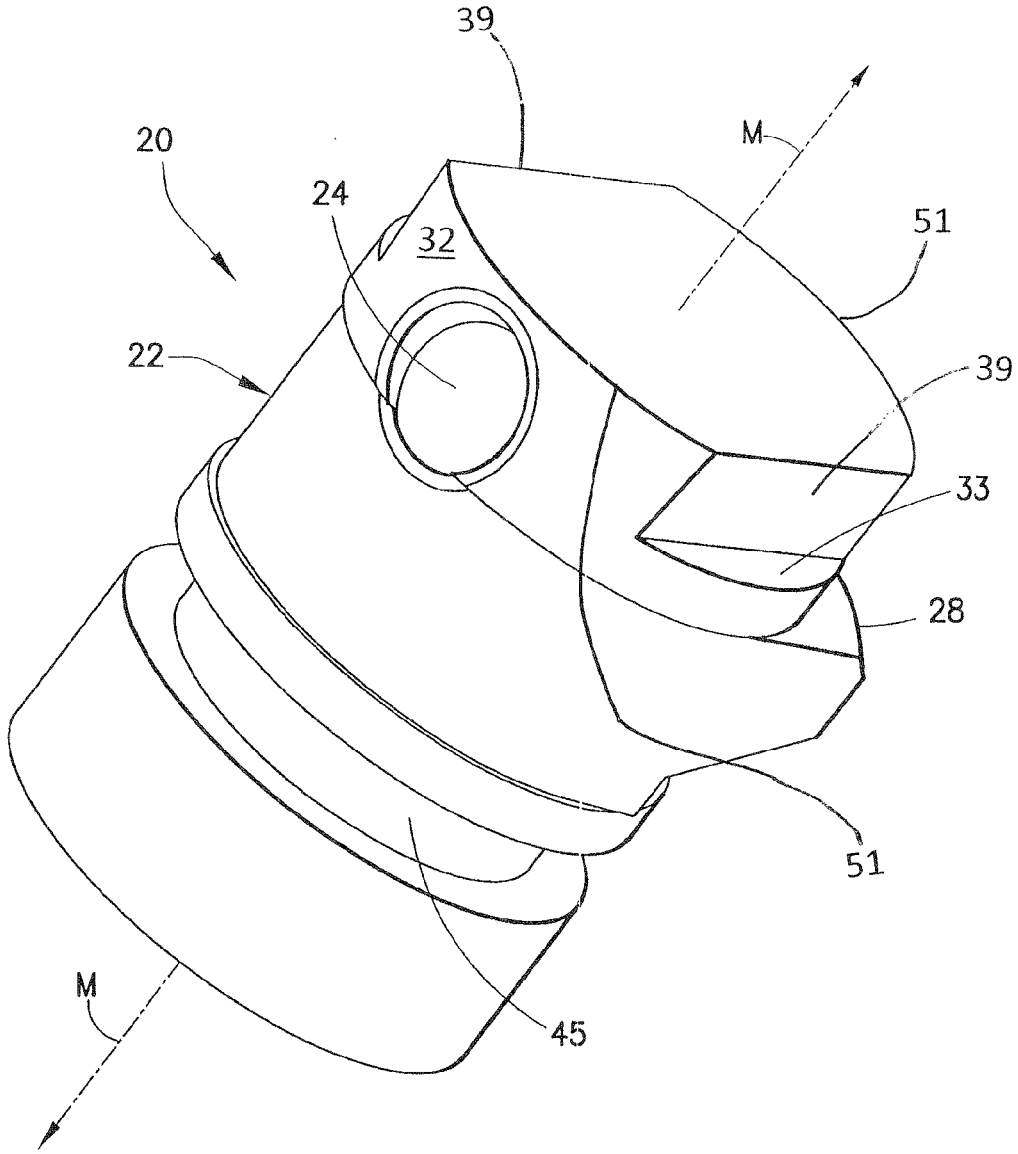
FIG. 1 is a perspective view of a centrifuge nozzle of the present invention.
Figure 2:
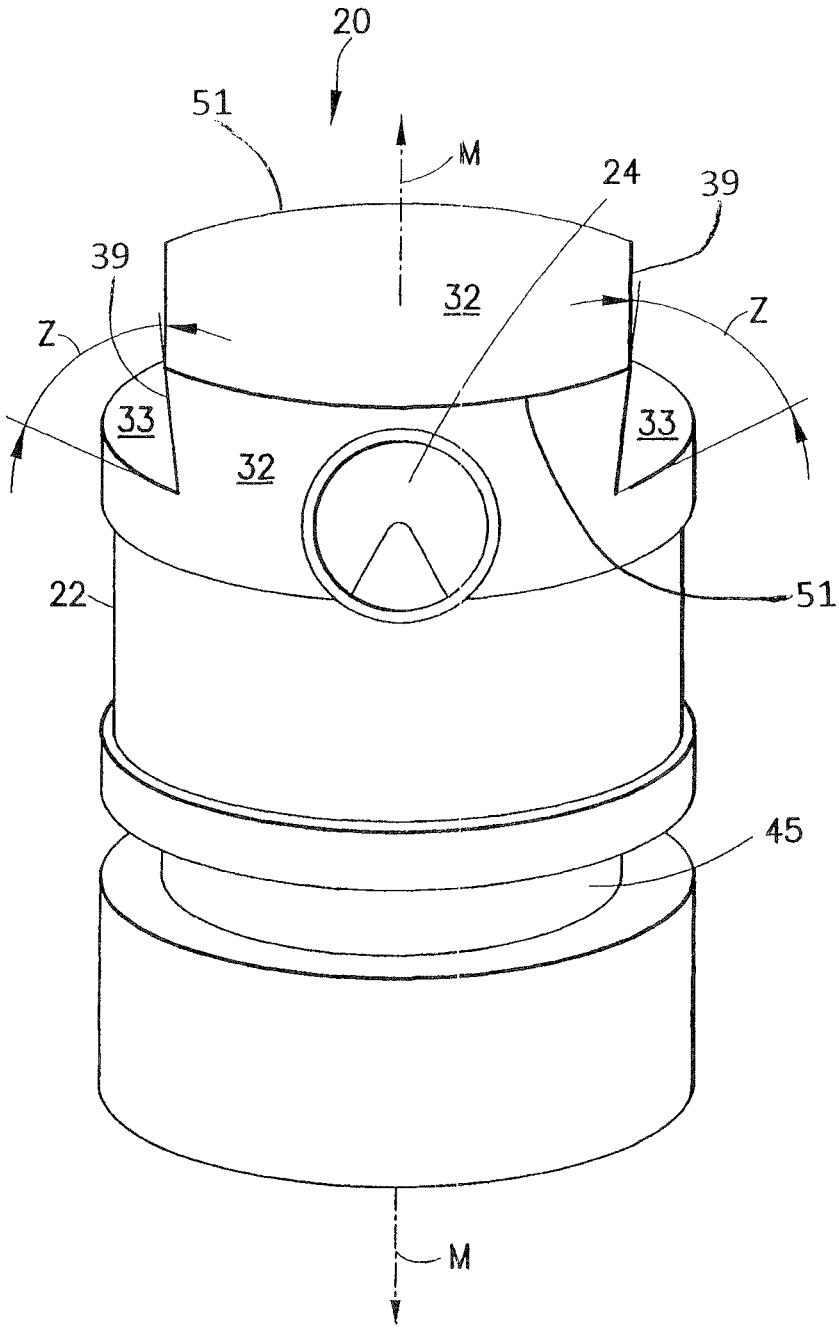
FIG. 2 is a perspective view of the front of the centrifuge nozzle of FIG. 1.
Figure 3:
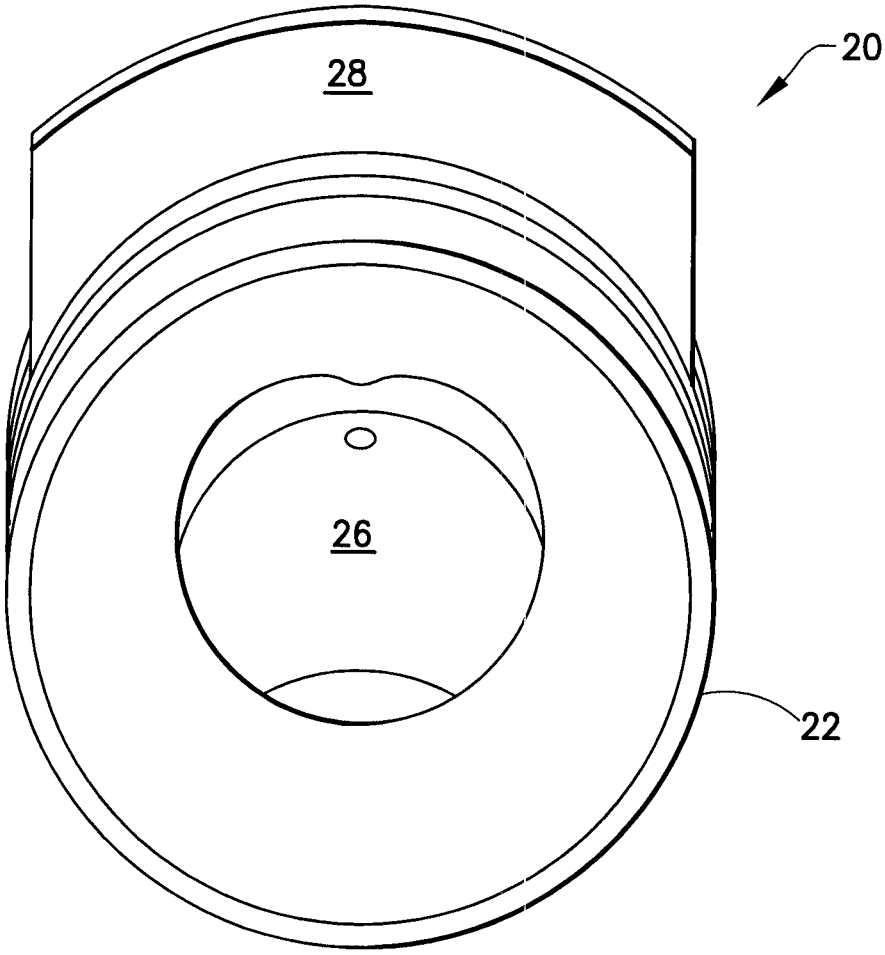
FIG. 3 is a bottom view of the centrifuge nozzle of FIG. 1.

As shown in FIGS. 1-3, a centrifuge nozzle made in accordance with the present invention is generally designated by the reference number 20 and includes a nozzle body generally designated by the reference number 22. In the illustrated embodiment, the nozzle body 22 is substantially cylindrical in shape and defines an axially extending longitudinal axis designated by the letter "M." The nozzle body 22 also defines an outlet 24 (FIGS. 1 and 2) in fluid communication with an inlet 26 (FIG. 3). As best shown in FIGS. 1 and 3, the nozzle body 22 also defines a radially projecting camming surface 28 adapted to frictionally engage a surface defined by a rotor bowl 30 (FIG. 7) to releasably secure the centrifuge nozzle 20 to the rotor bowl.

Figure 11:
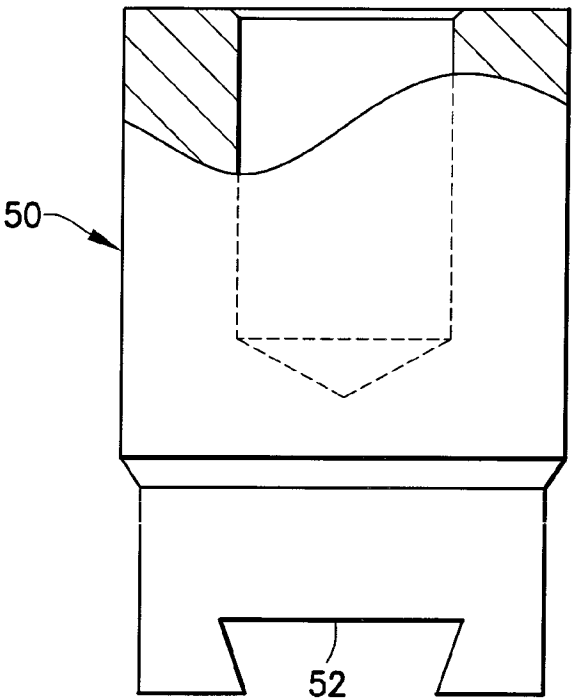
FIG. 11 is a partly schematic front view of the end of the nozzle insertion and extraction tool showing a dovetail-shaped slot adapted to slidably engage a dovetail-shaped portion of the centrifuge nozzle.
Figure 9:
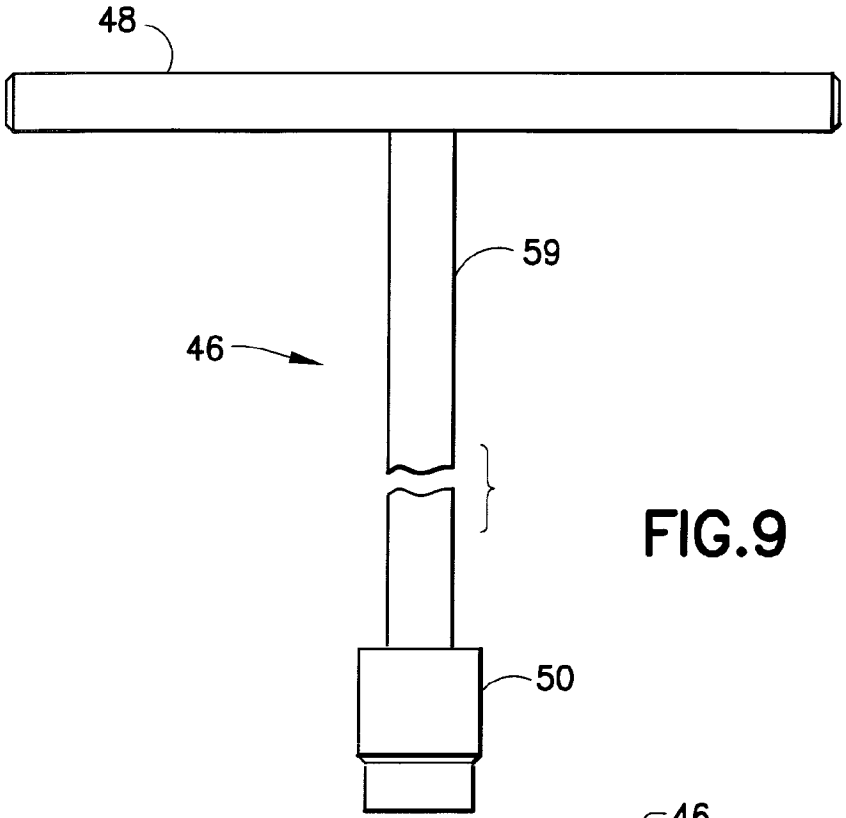
FIG. 9 is a front view of the nozzle insertion and extraction tool of the present invention.
Figure 10:
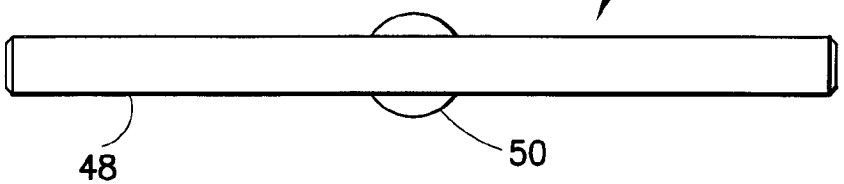
FIG. 10 is a top view of the nozzle insertion and extraction tool of FIG. 9.

Referring to FIG. 2, the nozzle body 22 also defines a male mounting portion 32, projecting outwardly from a surface 33 and shown in the illustrated embodiment as having a dovetail-shaped cross-section, the dovetail defining an angle "Z" relative to surface 33. The angle Z is preferably approximately 30 degrees. However, the present invention is not limited in this regard as angles other than 30 degrees can also be employed without departing from the broader aspects of the present invention. Also, while a dovetail-shaped projection has been shown and described, the present invention is not limited in this regard as other suitable shapes such as, but not limited to, cylinders can be substituted without departing from the broader aspects of the present invention. In any embodiment, the male mounting portion 32 is defined by two opposing straight edges 39 which extend between curved portions 51 of the mounting portion 32. Each of the opposing straight edges 39 are straight (e.g., flat). The mounting portion 32 is configured to be slidably received in a mating female slot 52 defined by a nozzle insertion and extraction tool 46 as illustrated in FIGS. 9-11.

The nozzle body can be made of any suitable material and can be composed entirely of a hard wear resistant material, such as, but not limited to tungsten carbide. The nozzle body 22 includes an O-ring groove 45 cut, machined, cast, or otherwise formed into the outer surface of the body. An O-ring is positioned in the groove 45 prior to inserting the nozzle in the bowl, thereby allowing the nozzle to sealingly engage the bowl. Accordingly, during operation the O-ring (not shown) prevents material from escaping from the bowl around the outer periphery of the nozzle body.

Figure 4:
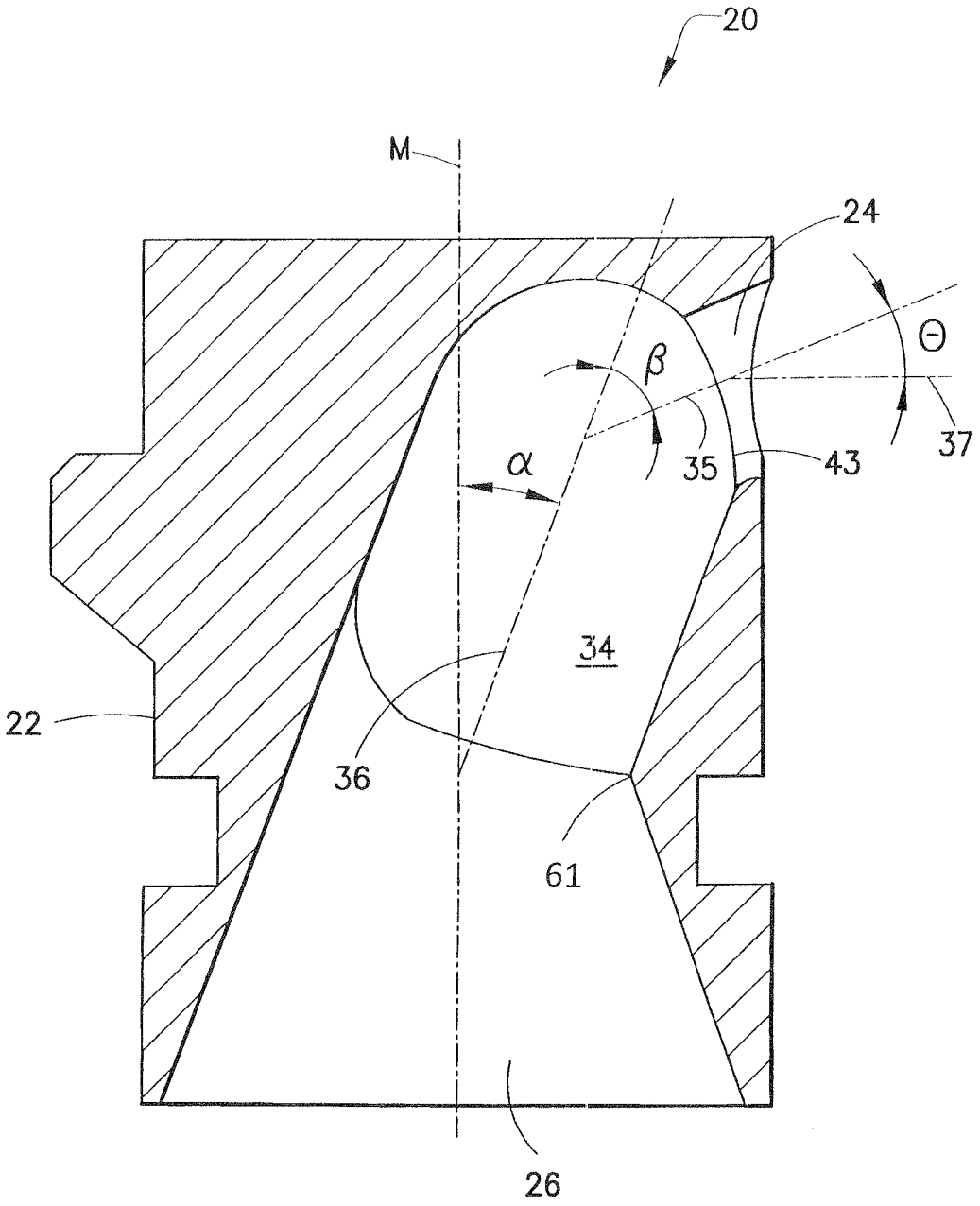
FIG. 4 is a cross-sectional view of the centrifuge nozzle of FIG. 1.

As shown in FIG. 4, the inlet 26 of the nozzle 20 is substantially coaxial with the axis M and progressively tapers to a junction 32. A flow passage 34 extends from the junction 61 and is defined by a substantially uniform cross-section. The flow passage 34 is in fluid communication with the outlet 24 and defines a second longitudinal axis 36 oriented at an angle α relative to the axis M. The outlet 24 defines a centerline 35 oriented at an angle β relative to the second longitudinal axis 36. The outlet centerline 35 is oriented at an angle θ measured relative to an axis 37 extending in a first coordinate direction approximately perpendicular to the axis M. Preferably, the angle θ is approximately 10 degrees but can also be between 5 and 10 degrees; however, the present invention is not limited in this regard as other angles can also be employed without departing from the broader aspects of the present invention.

In the illustrated embodiment, the flow passage 34 and the outlet 24 meet at and define sharp edge 43. However, the present invention is not limited in this regard as the edge 43 can also be chamfered or radiused without departing from the broader aspects of the present invention.

Figure 5:
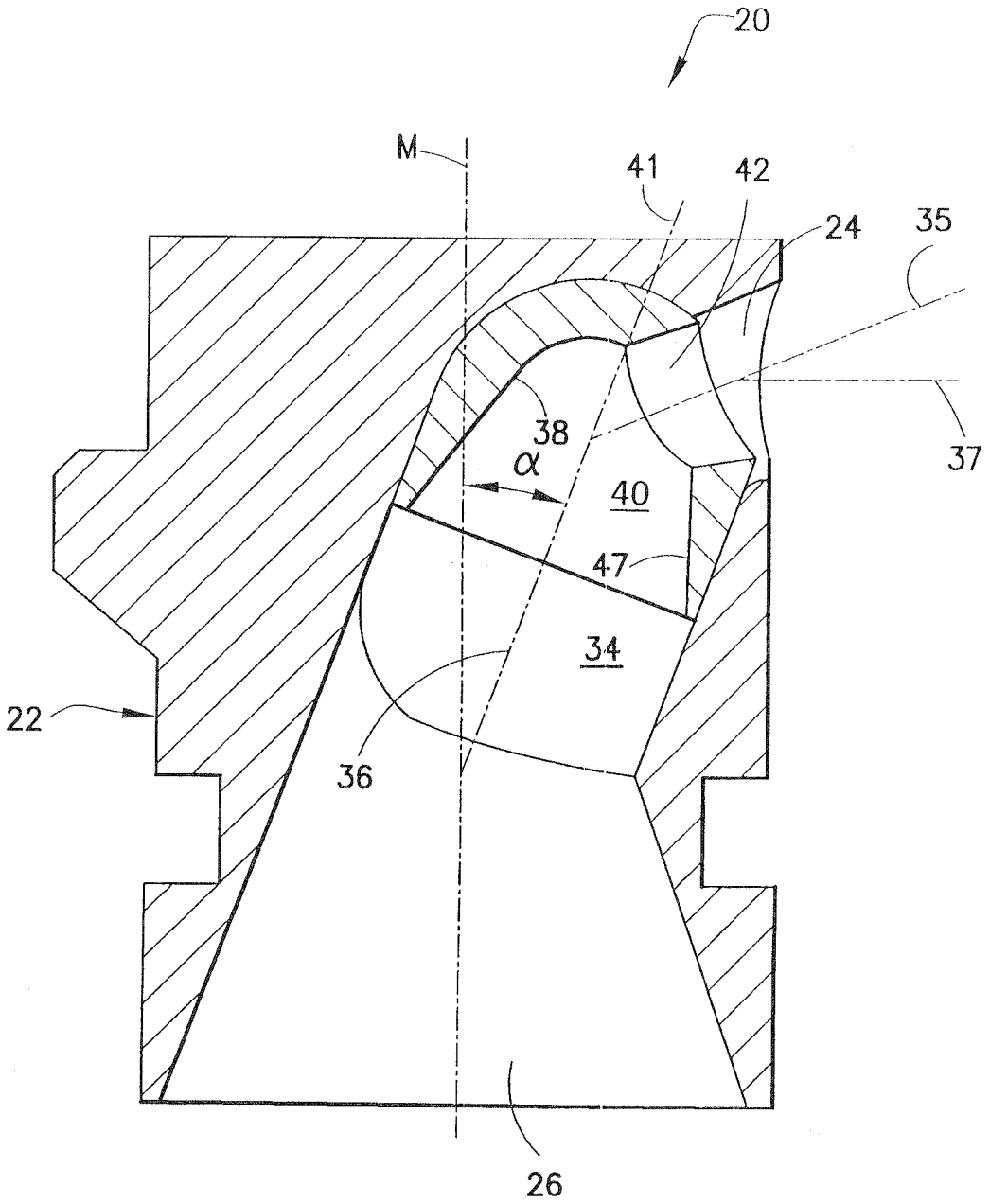
FIG. 5 is a cross-sectional view of the centrifuge nozzle of FIG. 1 having a nozzle insert.
Figure 6:
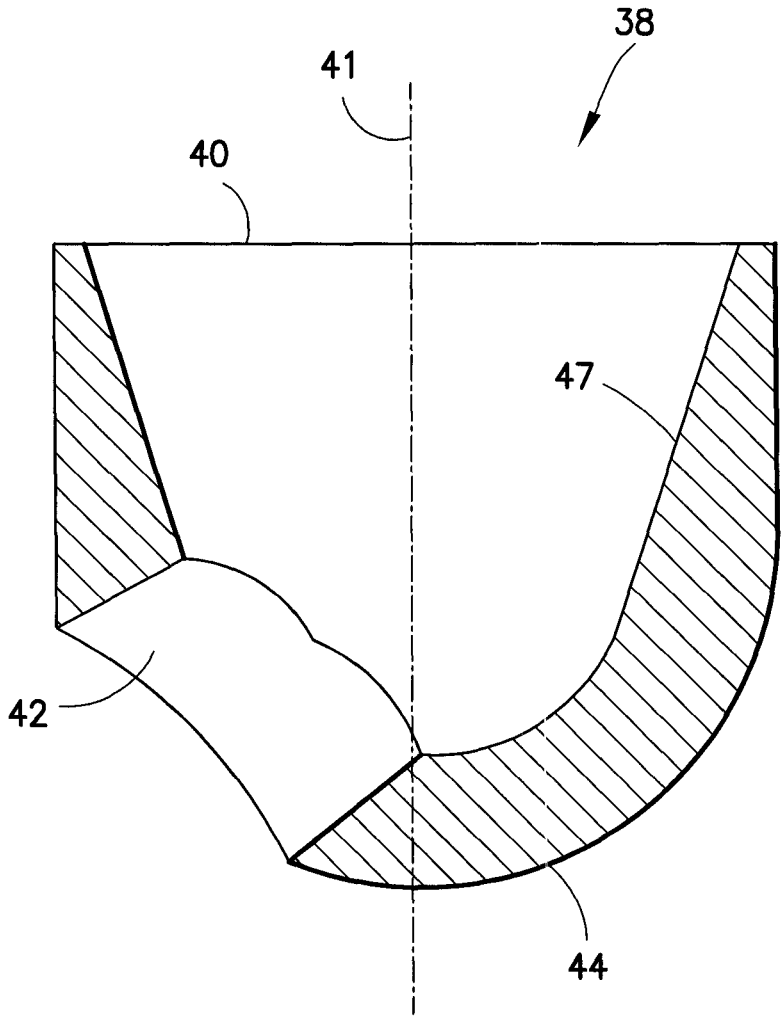
FIG. 6 is a cross-sectional view of the centrifuge nozzle insert.

Referring now to FIGS. 5 and 6, the nozzle body 22 may, in an alternate embodiment, have a nozzle insert 38 mounted therein. The nozzle insert 38 is positioned in the flow passage 34. The nozzle insert 38 includes an inlet passage 40 that defines an axis 41 approximately coaxial with the axis 36 defined by the passage 34. The nozzle insert 38 also defines an outlet passage 42 that is approximately coaxial with the outlet 24 defined by the nozzle body 22.

An outer surface 44 of the nozzle insert 38 is adapted to engage a complementarily-shaped receiving surface defined by the nozzle body 22. Thin nozzle insert 38 is installed by inserting the insert into the nozzle body 22 from the inlet end thereof. The nozzle insert 38 is supported in the nozzle body 22 over a large contact area, thereby decreasing local stresses to which the insert would be otherwise exposed. Preferably, an inner surface 47 of the nozzle insert 38 is tapered or otherwise configured to direct fluid to the insert outlet 42. The nozzle insert 38 may be made from any suitable material such as, but not limited to, tungsten carbide or ceramic.

Figure 7:
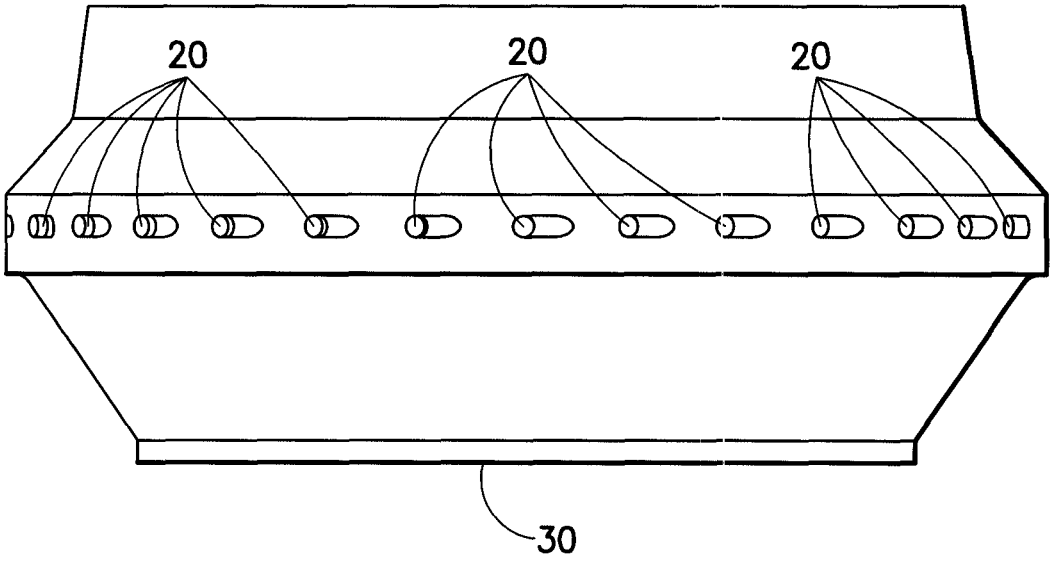
FIG. 7 is a side view of a rotor bowl showing a plurality of centrifuge nozzles installed therein.

Referring now to FIG. 7, the nozzles 20 are removably secured in the rotor bowl 30. The rotor bowl 30 in turn is rotatably positionable in a centrifuge housing (not shown). In order to releasably secure the above-described nozzles 20 in the rotor bowl 30, an insertion and extraction tool is used.

Figure 8:
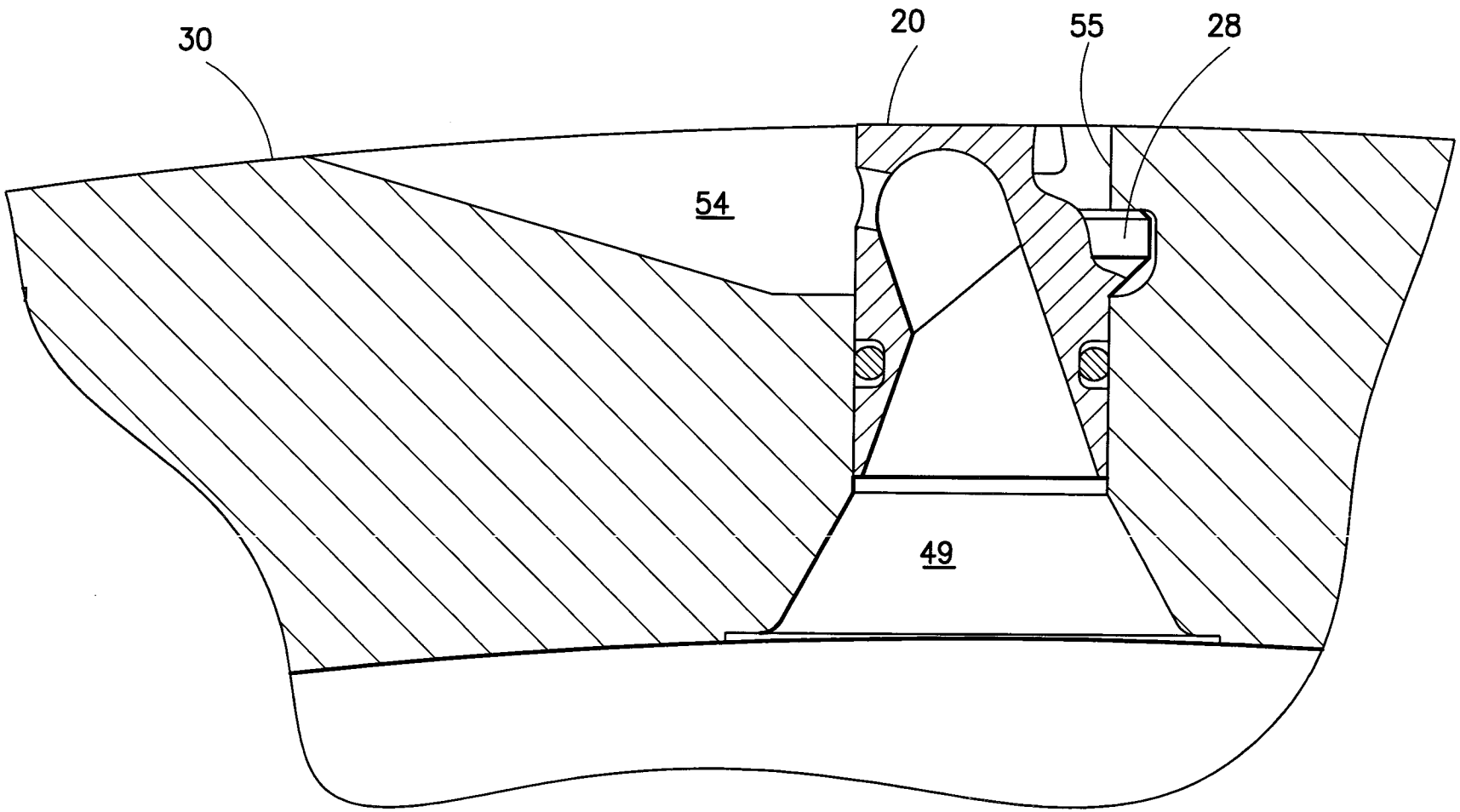
FIG. 8 is a side view of a teardrop-shaped recess of a surface of a rotor bowl in which the nozzle of FIG. 1 may be inserted.

Referring now to FIG. 8, a surface of the rotor bowl 30 in which a nozzle 20 is mounted is defined by a tear-drop shaped recess 54. A lip 55 projects outwardly from a portion of the recess 54. As will be explained in detail below, when the nozzle 20 is inserted into the opening 49, it is rotated until the camming surface 28 is under the lip 55 and frictionally engages the bowl 30. In this manner, during operation, the nozzle 20 will not be jettisoned from the bowl 30 due to centrifugal force.

The insertion and extraction tool is shown in FIGS. 9-11 and is generally designated by the reference number 46 and is hereinafter referred to as the tool. The tool 46 includes a handle portion 48, having a shaft portion 59 extending therefrom and an end portion 50 extending from the shaft portion. The end portion 50 defines an engagement slot 52, which in the illustrated embodiment extends generally parallel to the handle portion 48. The slot 52 is of a shape complementary to and therefore slidably engageable with the opposing straight edges 39 of the male mounting portion 32 defined by the nozzle body 22. Thus, when the tool 46 is engaged with the nozzle body 22 in an insertion or removal operation, a user is able to discern the orientation of the dovetail and thereby whether the nozzle is "locked" or "unlocked" relative to the camming surface 28 radially projecting from the nozzle body. In addition, due to the configuration of the tool 46, it cannot be separated from a nozzle 20 unless the nozzle is properly installed in the bowl 30. Because the tool 46 must be slid off of the nozzle 20, proper alignment of the nozzle relative to the teardrop recess is necessary to provide sufficient clearance for the tool to be removed. Moreover, because the opposing straight edges 39 (FIG. 2) of the nozzle and the slot 52 of the tool 46 are each complementarily dovetail-shaped (e.g., the slot 52 is a female shape and the male mounting portion 32 is a male shape), the insertion and extraction tool 46 releasably retains the nozzle when it is engaged therewith.

Figure 12:
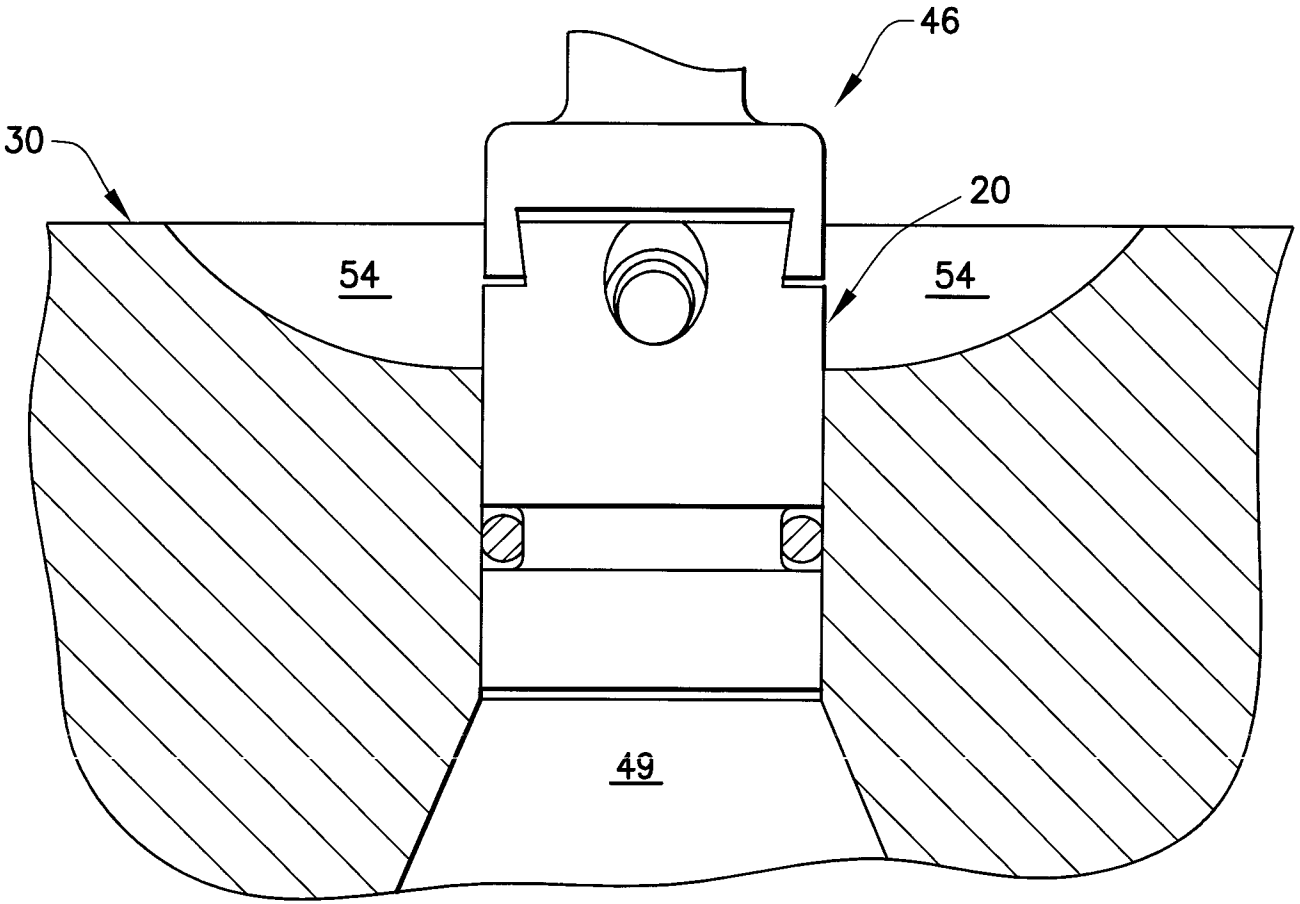
FIG. 12 is a partial, partly in section front view of the insertion and extraction tool of FIGS. 9-11 being used to install the centrifuge nozzle of FIG. 1 into a rotor bowl.

Referring now to FIG. 12, to insert the nozzle 20 into the opening 49 defined by a surface of the rotor bowl 30, the nozzle is first mounted onto the tool 46. Next, the nozzle 20 is inserted into the bore defined by the bowl 30 and turned until the camming surface 28 (FIG. 8) engages the rotor bowl, thereby frictionally and releasably securing the centrifuge nozzle to the rotor bowl. When the nozzle 20 is properly installed, the tool 46 is oriented so that the tool can be slid off the nozzle along the tear-drop shaped recess 54 of the rotor bowl 30. As previously stated, if the nozzle 20 is not properly aligned, then the tool 46 will not be properly aligned with the tear-drop shaped recess 54, thereby resulting in an inability to slide the tool 46 off of the nozzle towards the tear-drop shaped recess.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A centrifuge nozzle wherein the centrifuge nozzle includes:

a nozzle body defining an inlet in fluid communication with a nozzle outlet;

a camming portion projecting radially outwardly from said nozzle body and defining a surface frictionally engageable with a portion of a rotor bowl;

said nozzle body being cylindrical and adapted to be slidably engaged and releasably positioned in an aperture defined by said rotor bowl so that upon engagement of said nozzle body into said aperture, said nozzle body can be rotated to cause said camming portion to engage said rotor bowl;

said nozzle body defining a male mounting portion for slidably engaging a complimentarily shaped female slot defined by a nozzle insertion and extraction tool, said male mounting portion defining a dove-tail shaped cross-section having opposing straight edges;

said outlet is located adjacent to said male mounting portion; and said inlet progressively tapers to an approximately cylindrical flow passage oriented at an angle relative to said inlet, said flow passage being in fluid communication with said nozzle outlet.

2. A centrifuge nozzle as defined by claim 1 wherein:

said nozzle body defines a longitudinal axis M extending axially thereof in a first coordinate direction;

said nozzle outlet being symmetrical about a centerline, said centerline being angularly offset relative to a second coordinate direction, said second coordinate direction being perpendicular to said first coordinate direction.

3. A centrifuge nozzle as defined by claim 2 wherein said angular offset is approximately ten degrees.

4. A centrifuge nozzle as defined by claim 2 wherein said angular offset is between about five degrees and less than 10 degrees.

5. A centrifuge nozzle as defined by claim 1 further including an insert positioned in said nozzle body, said insert having an inlet passage in fluid communication with said inlet defined by said nozzle body, and an outlet passage in fluid communication with and approximately coaxial with said outlet defined by said nozzle body.

6. A centrifuge nozzle as defined by claim 5 wherein said insert is made from tungsten carbide.

* * * * *